United States Patent [19]

Schulz

[11] Patent Number: 4,969,238

[45] Date of Patent: Nov. 13, 1990

[54] APPARATUS FOR SELECTIVELY SECURING A CARRIER MEMBER OF A TEXTILE DRAFTING APPARATUS

[75] Inventor: Günter Schulz, Ebersbach/Fils, Fed. Rep. of Germany

[73] Assignees: Zinser Textilmaschinen GmbH, Ebersbach/Fils; Spindelfabrik Sussen, Schurr, Stahlecker & Grill GmbH, Sussen, both of Fed. Rep. of Germany

[21] Appl. No.: 432,784

[22] Filed: Nov. 6, 1989

[30] Foreign Application Priority Data

Nov. 5, 1988 [DE] Fed. Rep. of Germany ..... 3837667

[51] Int. Cl.[5] ..... D01H 5/44

[52] U.S. Cl. ..... 19/266; 19/260; 19/261; 19/267

[58] Field of Search ..... 19/250, 260, 261–267, 19/280, 282

[56] References Cited

U.S. PATENT DOCUMENTS

| | | | |
|---|---|---|---|
| 1,104,932 | 7/1914 | Reynolds et al. | 19/266 |
| 1,443,111 | 1/1923 | Albrecht | 19/260 |
| 2,306,849 | 12/1942 | Toenniessen | 19/261 |
| 2,565,228 | 8/1951 | Gwaltney et al. | 19/266 |
| 2,635,299 | 4/1953 | Abernethy | 19/266 |
| 2,666,231 | 1/1954 | Stahlecker | 19/266 |
| 2,689,383 | 9/1954 | Burnham et al. | 19/282 |
| 2,728,111 | 12/1955 | Werth et al. | 19/260 |
| 2,885,740 | 5/1959 | Thompson et al. | 19/261 |
| 2,941,263 | 6/1960 | Kübler | 19/266 |
| 3,568,258 | 3/1971 | Schiltknecht et al. | 19/261 |
| 3,619,870 | 12/1969 | Nobugiooki et al. | 19/282 |
| 3,732,596 | 5/1973 | Staneff | 19/267 |
| 4,538,329 | 9/1985 | Sakai et al. | 19/250 |

FOREIGN PATENT DOCUMENTS

| | | | |
|---|---|---|---|
| 1087496 | 12/1958 | Fed. Rep. of Germany . | |
| 141411 | 1/1961 | U.S.S.R. | 19/280 |
| 822352 | 10/1959 | United Kingdom | 19/260 |
| 898803 | 4/1960 | United Kingdom . | |
| 1167179 | 10/1969 | United Kingdom | 19/282 |

OTHER PUBLICATIONS

DE-Firmenschrift: Suessen WST, Technische Mitteilung, "Universalbelasturgstrager UTcCC/LT620", 228d. 6.72, 6.

*Primary Examiner*—Werner H. Schroeder
*Assistant Examiner*—John J. Calvert
*Attorney, Agent, or Firm*—Shefte, Pinckney & Sawyer

[57] ABSTRACT

A textile drafting apparatus of the type having upper and lower drafting rollers forming a plurality of roller nips for travel therebetween of a textile strand includes a carrier member for adjustably supporting the upper drafting rollers. The textile drafting apparatus includes a force-applying member for applying a downward roller nip force through the carrier member to the rollers. The force-applying member is intermediately transversely offset from the longitudinal center line of the carrier member for permitting access to attaching studs for sliding of the attaching studs in longitudinal slots on the carrier member to adjust the position of the upper drafting rollers in the carrier member. According to another aspect of the present invention, the textile drafting apparatus includes a template device for positioning an upper drafting roller at a predetermined spacing from the pivoting shaft of the carrier member.

7 Claims, 1 Drawing Sheet

APPARATUS FOR SELECTIVELY SECURING A CARRIER MEMBER OF A TEXTILE DRAFTING APPARATUS

BACKGROUND OF THE INVENTION

The present invention relates to an apparatus for selectively positioning an upper roller of a drafting apparatus of a textile machine in selected operating positions.

The drafting apparatus of textile machine drafts roving or other textile material from a supply of such material. The drafting apparatus typically includes three associated pairs of rollers, each roller pair having an upper roller and a lower roller and with the upper rollers mounted on a carrier member generally pivotally mounted at one end on a pivot shaft for pivoting between an operating position in which the upper rollers are cooperatively disposed with respect to their associated lower rollers to form nips therebetween for the feed of the textile material through the nips and a non-operating position in which the upper rollers are supported at a spacing upwardly from their respective associated lower rollers.

To releasably maintain the carrier member in its operating position, in which the associated pairs of upper and lower rollers are cooperatively disposed for the feed of roving therethrough, the drafting apparatus typically also includes a force-applying member mounted at one end to the carrier member and extending over the top of the carrier member to a free end position which contacts the carrier member to apply a downward roller nip pressure. The force-applying member extends generally centrally laterally over the top of the carrier member.

Each upper roller is rotatably supported on a bracket assembly which is adjustably mounted to the carrier member. The bracket assembly is typically adjustably fixedly secured to the carrier member by a vertically extending attaching stud adjustably movable along a slot on the top of the carrier member and having a top end extending through and above the top of the carrier member for releasable securement for securement thereto. Accordingly, the bracket assembly can be selectively released from its fixed position on the carrier member to allow adjustable positioning of the associated upper roller supported thereon by selectively loosening the attaching stud for movement along the slot in the carrier member, which typically extends in the direction of the feed of the roving. Once the bracket assembly has been repositioned to a new location, the attaching stud is again engaged to fixedly secure the bracket assembly to the carrier member to fix the upper roller in its selected position relative to the carrier member.

The slots along which the attaching studs are movable are located generally along the longitudinal center line of the carrier member. Accordingly, as can be understood, the force-applying member typically extends directly over the slots in superposed relation. To gain access to the top ends of the attaching studs for adjusting the bracket assemblies, it is therefore generally necessary to displace the force-applying member from its operating position in which it urges the carrier member downwardly to bring the upper and lower rollers into feeding engagement with one another.

Accordingly, the need exists for a textile drafting device which permits relatively quick and simple access to and adjustment of the upper roller bracket assemblies for adjusting the position of the upper rollers.

SUMMARY OF THE INVENTION

The present invention provides a textile drafting apparatus which permits adjustment of the position of the upper roller bracket assemblies for adjusting the position of the upper rollers in a simple and expedient manner.

Briefly described, the present invention provides a textile drafting apparatus of the type in which upper drafting rollers are supported from brackets that are longitudinally adjustably secured to pivoted carrier members by attaching studs slidable in longitudinal slots extending along the general longitudinal center line of the carrier members and releasably secured thereto, and which pivoted force-applying members extend longitudinally above the carrier members and generally along the longitudinal center line of the carrier members, the force-applying members contacting the carrier members above the rollers to apply a downward roller nip force through the carrier members, brackets and rollers. The force-applying members are intermediately transversely offset from the slots of the carrier members to allow access to the studs for sliding thereof in the slots to adjust the position of the brackets and rollers in the carriers members.

Preferably, the force-applying members are in the form of vertical plates preferably of iron, having end sections generally along the longitudinal center line of the carrier members and sections intermediate the end sections which are transversely offset from the slots. The carrier members include recesses disposed rearwardly along the longitudinal center line for receiving the carrier members therebetween.

According to the preferred embodiment of the present invention, respective ones of the end sections of the force-applying members are trailing with respect to the direction of travel of a strand through the textile drafting apparatus and are attached to the carrier members and respective others of the end sections of the force-applying members are leading with respect to the direction of travel of a strand through the textile drafting apparatus and contact the carrier members above the rollers for applying a roller nip force thereto.

Preferably, the carrier members are formed with inverted U-shaped cross sections with generally flat top surface having the slots formed therein. The top surface of the carrier members have trailing end portions extending downwardly and are rearwardly slotted along the longitudinal center lines of the carrier members, the trailing end sections of the force-applying members extending downwardly end sections of the force-applying members extending downwardly through the slotted trailing end portions of the carrier members.

According to one form of the present invention, there is provided a template means for a textile drafting apparatus of the type in which an upper drafting roller is adjustably supported on a carrier member, the roller being rotatable on a shaft about a roller axis extending generally transverse to the direction of travel of the textile material traveling through the drafting apparatus, and the carrier member being pivotally mounted on a pivot shaft extending generally transverse to the direction of travel of the textile material.

The template means includes a carrier shaft engaging portion, a roller shaft engaging portion, and a portion adjustably interconnecting the carrier shaft engaging portion and the roller shaft engaging portion for adjustably positioning the roller shaft longitudinally with respect to the direction of travel of the textile strand through the textile drafting apparatus.

Preferably, the carrier shaft engaging portion and the roller shaft engaging portion extend rearwardly with respect to the carrier pivot shaft and the adjustably interconnecting portion interconnects the carrier shaft engaging portion and the roller shaft engaging portion rearwardly of the carrier shaft and the roller shaft. A selected one of the carrier shaft engaging portion and the roller shaft engaging portion is preferably slidably connected to the adjustably interconnecting portion for sliding movement generally parallel to the direction of travel of the textile strand through the textile drafting apparatus.

According to another aspect of the present invention, there is provided a method for adjusting the position of an upper drafting roller of a textle apparatus, the roller rotatable about a roller axis extending generally transverse to the direction of travel of the textile material traveling through the drafting device and being adjustably mounted on a carrier member of the type pivotally mounted to the textile machine on a pivot shaft extending generally transverse to the direction of travel of the textile material. The method includes first positioning a template means having a carrier shaft engaging portion, a roller shaft engaging portion, and a portion adjustably interconnecting the carrier shaft engaging portion and the roller shaft engaging portion on the textile drafting apparatus with a selected one of the carrier shaft engaging portion and the roller shaft engaging portion engaging a selected one of the carrier shaft and the roller shaft. Then, the position of the other of the carrier shaft and the roller shaft is adjusted into general position for engagement thereof by the other of the selected one of the carrier shaft engaging portion and the roller shaft engaging portion of the template means. Finally, the other of the carrier shaft and the roller shaft is engaged with the other of the carrier shaft engaging portion and the roller shaft engaging portion to position the carrier shaft and the roller shaft at a predetermined relative spacing.

DETAILED DESCRIPTION OF THE PREFERRED EMBODIMENT

Figures 1, 2, 3:
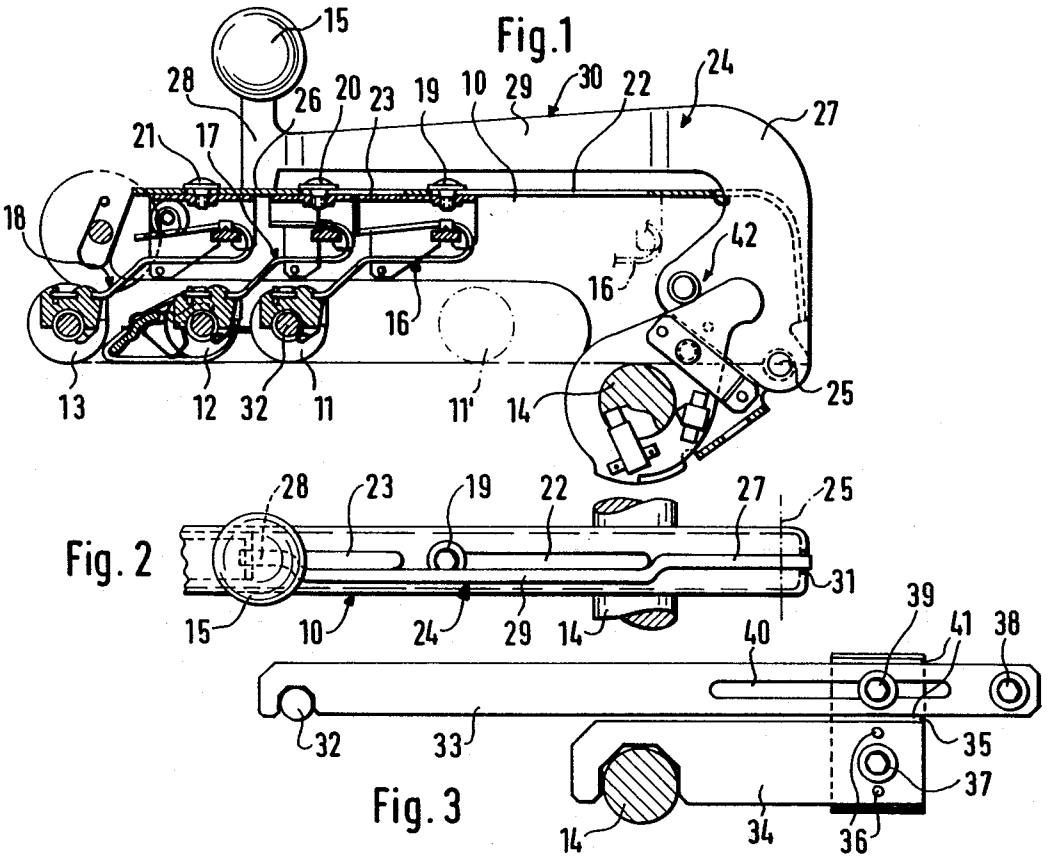
FIG. 1 is a side elevational view, in partial section, of a textile drafting apparatus, incorporating the preferred embodiments of the present invention.
FIG. 2 is a plan view of a portion of the textile drafting apparatus shown in FIG. 1.
FIG. 3 is a front elevational view of the template means of the present invention.

In FIGS. 1 and 2, the preferred embodiment of the textile drafting apparatus of the present invention is illustrated. The textile drafting apparatus is of the type for drafting a strand of textile material such as, for example, roving or yarn. The textile drafting apparatus includes a conventional carrier member 10 pivotally mounted on a shaft extending along the length of a textile machine such as, for example, a spinning machine, for pivoting about an axis 14 generally transverse to the direction of travel of the textile material through the drafting apparatus. The carrier member 10 has, in transverse cross section, an inverted U-shaped and has a generally flat top surface having longitudinal slots 22, 23 formed therein extending along the general longitudinal center line of the carrier member. The top surface of the carrier member 10 includes a trailing end portion extending downwardly and being rearwardly slotted with a vertical slot 31 generally aligned with the longitudinal center line of the carrier member 10.

The textile drafting apparatus additionally includes a plurality of associated pairs of upper and lower drafting rollers (only the upper drafting rollers being illustrated) and the associated pairs of upper and lower drafting rollers each define therebetween a roller nip through which the textile strand travels during the drafting operation. As seen in FIG. 1, the upper drafting rollers include a trailing roller 11, which is the trailing roller with respect to the direction of travel of the textile strand through the textile drafting apparatus, an intermediate roller 12 and a leading roller 13. The rollers 11, 12 and 13 are each adjustably fixedly supported on the carrier member 10 by a conventional bracket 16, 17 and 18. The trailing upper roller 11 has a shaft 32 mounted on the bracket 16 for rotation about an axis transverse to the direction of travel of the textile strand through the textile drafting apparatus. The shaft 32 extends generally parallel to the pivot axis 14 of the carrier member. The brackets 16, 17 and 18 are individually longitudinally adjustably secured to the carrier member 10 by attaching studs 19, 20 and 21, respectively and tightened by conventional means, such as the stud screws being threaded into the carrier members. The attaching studs 19 and 20 of the two trailing brackets are slidably disposed in the pair of longitudinal slots 22, 23, respectively, extending along the general longitudinal center line of the carrier member 10 and the attaching stud 19 and 20. The attaching stud 20 of the leading bracket 18 is disposed in a throughbore in the carrier member 10 for releasably fixedly securing the bracket 18 to the carrier member 10.

The attaching studs 19 and 20 are each in the form of a screw having a rounded head with a linear slot for receiving the tip of a screwdriver or a similar adjusting tool for rotating the attaching stud to selectively and secure the attaching stud to the carrier member 10. Accordingly, the brackets 16, 17 are adjustable in conventional manner through selective threading and unthreading of the attaching studs 19 and 20, respectively, to adjust the positions of the upper rollers 11, 12, respectively, with respect to the direction of travel of the textile strand through the textile drafting apparatus. For example, the bracket 16 can be adjusted from the solid line position shown in FIG. 1 to the broken line position 16′ shown in FIG. 1, whereby the trailing roller 11 is adjusted relative to the direction of travel of the textile strand to the position 11′ shown in FIG. 1.

The textile drafting apparatus additionally includes a force-applying member 24 extending longitudinally above the carrier member 10 and generally above the longitudinal center line thereof, for contacting the carrier member 10 above the upper rollers 11, 12 and 13 to apply a downward roller nip force through the carrier member 10, the brackets 16, 17 and 18 and the upper rollers 11, 12 and 13.

The force-applying member 24 includes a trailing end section 27, which is trailing with respect to the direction of travel of the textile strand, a leading end section 28 and an intermediate section 29 connected to one end to the trailing end section 27 and at its other end to the leading end section 28. The trailing end section 27, the intermediate section 29 and the leading end section 28 are preferably an integrally formed iron plate. The leading end section 28 contacts the carrier member 10 above the upper drafting rollers 11, 12 and 13 for applying a roller nip force thereto. The leading end section 28 includes a conventional spherically shaped hand gripping member 15 secured thereto. The leading end section 28 contacts the carrier member 10 generally at the longitudinal center line of the carrier member 10.

The trailing end section 27 extends vertically in the slot 31 of the carrier member 10 and is pivotally mounted to the carrier member 10 for rotation of the force-applying member 24 about an axis 25 which is parallel to the pivot axis 14 of the carrier member 10. Additionally, the trailing end section 27 includes a stop member 42 of a conventional stop member assembly which cooperates with the carrier member 10 to selectively secure the force-applying member 24 relative to the carrier member 10 in conventional manner.

In accordance with the present invention, and as seen in FIG. 2, the force-applying member 24 is intermediately transversely offset from the longitudinal slots 22, 23 of the carrier member 10 to allow access to the attaching studs 19 and 20 of the two trailing brackets 16, 17 for selectively releasing the attaching studs for sliding thereof in the longitudinal slots 22 and 23 to adjust the position of the brackets 16, 17 and their respective trailing rollers 11 and 12 in the carrier member 10. Specifically, the intermediate section 29 of the force-applying member 24 has an extent which extends parallel to the longitudinal slot 22 and offset transversely thereof sufficiently to permit access therepast of a screwdriver or other adjustment tool for engaging the attaching studs 19 and 20. However, the intermediate section 29 does not extend transversely beyond the carrier member 10—that is, the entire extent of the intermediate secton 29 is in superposed relation with the carrier member 10.

Accordingly, the textile drafting apparatus of the present invention permits ready access to the adjusting studs 19 and 20 without the necessity of moving the force-applying member 24 from its operating position in which it applies a downward roller nip force though the carrier member 10.

In FIG. 3, another aspect of the present invention is illustrated. The textile drafting apparatus illustrated in FIGS. 1 and 2 is schematically represented by the shaft 32 of the trailing upper roller 11 and the pivot shaft on which the carrier member 10 is pivotally mounted to the textile machine for pivoting about the axis 14. As discussed above, the shaft 32 is adjustably positionable with respect to the direction of travel of the textile strand through selective manipulation of the attaching stud 19 to permit movement of the bracket 16. In accordance with the present invention, a template means is provided to readily and accurately adjust the position of the trailing upper roller 11 with respect to the direction of travel of the textile strand through the textile drafting apparatus. The template means includes a carrier shaft engaging portion comprising a pair of identically configured non-sliding plates 34, a roller shaft engaging portion comprising a pair of identically configured sliding plates 33 and a component adjustably interconnecting the carrier shaft engaging portion and the roller shaft engaging portion for adjustment of the spacing of the carrier shaft engaging portion with respect to the roller shaft engaging portion longitudinally relative to the direction of travel of the textile strand through the textile drafting apparatus. Only one of the non-sliding plates 34 and one of the sliding plates 33 is illustrated in FIG. 3, the other of each respective plate being identical in configuration and operation. The adjustably interconnecting component 35 is adapted to be disposed rearwardly of the carrier member 10 and the force-applying member 24. A respective one of the non-sliding plates 34 is secured to a side of the adjustably interconnecting component 35 which is parallel to the direction of travel of the textile strand by a bolt 37 and a pair of rivets 36, whereby the non-sliding plate 34 is fixedly secured to the adjustably interconnecting portion 35. The other non-sliding plate 34 is secured in similar manner to the opposite parallel face of the adjustably interconnecting component 35 and the extent of the adjustably interconnecting component 35 between its opposite parallel faces to which the non-sliding plates 34 are attached is greater than the extent of the carrier member 10 transversely to the direction of travel of the textile strand such that the non-sliding plates 34 can be disposed on opposed sides of the carrier member 10 in straddling relation with the carrier member. Each non-sliding plate 34 includes a recess having an extent, as measured in the direction of travel of the textile strand, slightly greater than the diameter of the pivotal mounting shaft of the carrier member 10.

The sliding plates 33 of the roller shaft engaging portion are each slidably secured to a respective one of the opposite parallel faces of the adjustably interconnecting component 35. Specifically, each slidable plate 33 includes a longitudinal slot 40 and the adjustably interconnecting component 35 includes a pair of vertically spaced, parallel guide rails 41 on each opposite parallel face thereof, the guide rails 41 extending parallel to the direction of travel of the textile strand. Each slidable plate 33 has a vertical extent slightly less than the vertical spacing of the parallel guide rails 41 such that the slidable plate is received therebetween. A bolt 39 having a shaft portion receivable through the longitudinal slot of a sliding plate 33 and a head portion greater than the vertical extent of the slot 40 of the sliding plate is selectively threadable and unthreadable into the adjustably interconnecting component 35 to selectively secure and release the sliding plate 33 to the adjustably interconnecting compoment 35. Accordingly, each plate 33 is slidable in a direction parallel to the extent of the non-sliding plates 34 by selective movement of the longitudinal slot 40 of the sliding plate relative to the bolt 39.

Each sliding plate 33 includes, at its leading end, a recess having an extent, as measured in the direction of travel of the textile strand, slightly greater than the diameter of the roller shaft 32. Additionally, the sliding plates 33 are interconnected to one another by a bolt 38 extending transversely between the trailing ends of the plates and secured thereto in conventional manner. Accordingly, the pair of sliding plates 33 are movable as a single unit by appropriate releasing movement of their associated bolts 39 for adjusting the position of their leading end recess longitudinally with respect to the adjustably interconnecting component 35.

In operation, the template means is disclosed on the carrier member 10 with the non-sliding plates 34 and the sliding plates 33 in straddling relation to the carrier member and with the pivot shaft of the carrier member received within the recess of the non-sliding plates 34. Then, the attaching stud 19 is engaged to effect release the bracket 16 for adjustment of the shaft 32 of the trailing upper roller 11. Specifically, the attaching stud 19 is moved longitudinally relative to the carrier member 10 along the longitudinal slot 22 until the shaft 32 is generally positioned for engagement thereof by the leading end recesses of the sliding plates 33 of the roller shaft engaging portion. During this adjustment of the roller shaft 32, it may be necessary to slightly pivot the template means about the pivoting shaft of the carrier member 10 or to slightly vertically raise the template means to provide clearance of the shaft 32 past the leading end of the sliding plates 33. Once the roller shaft 32 is generally positioned for engagement by the leading end recesses of the sliding plates 33, the template means is manipulated to insure that the roller shaft 32 is, in fact, received in the leading end recesses of the sliding plate 33 whereby the operator can confirm that the roller shaft 32 is positioned at the selected predetermined position. With the roller shaft 32 properly positioned, the attaching stud 16 can again be engaged to fixedly secure the bracket 16 to maintain the roller shaft 32 at its position and the template means can then be removed.

The predetermined spacing between the pivoting shaft of the carrier member 10 and the roller shaft 32 can be infinitely adjusted by appropriate movement of the sliding plates 33 relative to the adjustably interconnecting component 35 through movement of the longitudinal slot 40 of the sliding plates relative to the bolts 39 to thereby set the desired position adjustment for the roller. The present invention also contemplates that the non-sliding plates 34 can be configured to engage the roller shaft 32 and the sliding plates 33 can be configured to engage the pivoting shaft of the carrier member 10. Additionally, the present invention contemplates that the templates means can be used to adjust the relative position of the shaft of the intermediate upper roller 12 relative to the pivoting shaft of the carrier member 10.

Alternatively, the templates means can be initially dispositioned with the roller shaft 32 engaged by the recesses of the sliding plates 33. Thereafter, the roller shaft 32, with the sliding plates 33 still in engagement therewith, can be moved until the recesses of the non-sliding plates 34 are generally positioned with the pivoting shaft of the carrier member 10. Then, the pivoting shaft of the carrier member 10 is engaged by the recesses of the non-sliding plate 34 to position the shaft of the carrier member 10 and the roller shaft 35 at a predetermined relative spacing.

It will therefore be readily understood by those persons skilled in the art that the present invention is susceptible of a broad utility and application. Many embodiment and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purpose of providing a full and enabling disclosure of the invention. The foregoing disclosure is not intended or to be construed to limit the present invention or otherwise to exclude any such other embodiments, adaptations, variations modifications and equivalent arrangements, the present invention being limited only by the claims appended hereto and the equivalents thereof.

I claim:

1. In a textile drafting apparatus of the type in which at least one upper drafting roller is supported from a bracket that is longitudinally adjustable secured to a pivoted carrier member by an attaching stud slidable in a longitudinal slot extending along the general longitudinal center line of the carrier member and releaseably secured thereto, and in which a pivoted force-applying member extends longitudinally above the carrier member and generally along the longitudinal center line of the carrier member, the force-applying member contacting the carrier member above the rollers to apply a downward roller nip force through the carrier member, brackets and rollers, the improvement comprising:

said force-applying member being intermediately transversely offset from the slot of the carrier member to allow access to said stud for sliding thereof in said slot to adjust the position of said bracket and roller in said carrier member.

2. In a textile drafting apparatus, the improvement according to claim 1 and characterized further in that said force-applying member is in the form of a vertical plate having end sections generally along the longitudinal center line of the carrier member and a section intermediate said end section which is transversely offset from said slot.

3. In a textile drafting apparatus, the improvement according to claim 2 and characterized further in that said carrier member includes recesses disposed rearwardly along said longitudinal center line for receiving said force-applying member therebetween.

4. In a textile drafting apparatus, the improvement according to claim 2 and characterized further in that said vertical plate is formed of iron.

5. In a textile drafting apparatus, the improvement according to claim 2 and characterized further in that respective ones of said end section of said force-applying member are trailing with respect to the direction of travel of a strand through the textile drafting apparatus and is attached to said carrier member and others of said end sections of said force-applying member are leading with respect to the direction of travel of a strand through the textile drafting apparatus and contact said carrier member above said roller for applying a roller nip force thereto.

6. In a textile drafting apparatus, the improvement according to claim 1 and characterized further in that said carrier member is formed with an inverted U-shaped cross section with a generally flat top surface having said at least one slot formed therein.

7. In a textile drafting apparatus, the improvement according to claim 6 and characterized further in that said top surface of said carrier member has trailing end portions extending downwardly and being rearwardly slotted along the longitudinal center lines of said carrier member, said trailing end sections of said force-applying member extending downwardly through said slotted trailing end portions of said carrier member.

* * * * *